US009242126B2

(12) United States Patent
Turiello

(10) Patent No.: US 9,242,126 B2
(45) **Date of Patent: *Jan. 26, 2016**

(54) BREATHABLE AIR SAFETY SYSTEM FOR CIVILIANS IN A BUILDING STRUCTURE IN AN EMERGENCY

(75) Inventor: Anthony J. Turiello, Portola Valley, CA (US)

(73) Assignee: RESCUE AIR SYSTEMS, INC., San Carlos, CA (US)

( * ) Notice: Subject to any disclaimer, the term of this patent is extended or adjusted under 35 U.S.C. 154(b) by 1076 days.

This patent is subject to a terminal disclaimer.

(21) Appl. No.: 12/177,884

(22) Filed: Jul. 23, 2008

(65) Prior Publication Data

US 2010/0032040 A1 Feb. 11, 2010

(51) Int. Cl.

| | |
|---|---|
| ***A62B 7/00*** | (2006.01) |
| ***A62B 15/00*** | (2006.01) |
| *A62B 7/02* | (2006.01) |

(52) U.S. Cl.

CPC . *A62B 15/00* (2013.01); *A62B 7/02* (2013.01); *Y10T 137/0318* (2015.04); *Y10T 137/877* (2015.04)

(58) Field of Classification Search

USPC ..... 128/204.18, 204.21, 200.24, 204.26, 128/202.13, 202.16, 205.25, 205.23; 454/49, 169–172, 254, 255, 284, 329, 454/338

See application file for complete search history.

(56) References Cited

U.S. PATENT DOCUMENTS

| | | | | | |
|---|---|---|---|---|---|
| 3,797,006 | A * | 3/1974 | Reininger | 340/530 |
| 3,842,410 | A * | 10/1974 | Gopperton | 340/545.2 |
| 3,893,095 | A * | 7/1975 | DeJong | 169/23 |
| 4,015,250 | A * | 3/1977 | Fudge | 169/23 |
| 4,278,453 | A * | 7/1981 | Klein | 96/117.5 |
| 4,375,637 | A * | 3/1983 | Desjardins | 340/517 |
| 4,418,336 | A * | 11/1983 | Taylor | 340/571 |
| 4,467,796 | A * | 8/1984 | Beagley | 128/202.13 |
| 4,640,278 | A * | 2/1987 | Barry | 128/206.12 |
| 4,905,684 | A * | 3/1990 | Heffer | 128/202.13 |
| 5,227,776 | A * | 7/1993 | Starefoss | 340/6.1 |
| 5,388,570 | A * | 2/1995 | Wassil | 128/200.24 |
| 5,570,685 | A * | 11/1996 | Turiello | 128/202.13 |
| 5,638,906 | A * | 6/1997 | McCabe | 169/51 |
| 5,730,121 | A * | 3/1998 | Hawkins et al. | 128/205.25 |
| 5,809,999 | A * | 9/1998 | Lang | 128/200.24 |
| 6,735,473 | B2 * | 5/2004 | Kolder et al. | 607/5 |

(Continued)

OTHER PUBLICATIONS

Great Buildings Drawing of $6^{th}$-$20^{th}$ Floors of the Empire State Building (1931). Accessed online on Sep. 17, 2014.*

*Primary Examiner* — Kristen Matter
(74) *Attorney, Agent, or Firm* — Raj Abhyanker, P.C.

(57) ABSTRACT

A method and/or system of a breathable air safety system for civilians in a building structure in an emergency. In one embodiment, the safety system includes a supply unit of a structure to facilitate delivery of breathable air from a source of compressed air to an air distribution system of the structure, a fill panel of the structure to provide a pressure of the breathable air such that the pressure is suitable for direct human consumption through a breathable air apparatus coupled with the fill panel, and a routing mechanism of the structure to provide a routing between the fill panel and other fill panels of a particular level through at least one of a wall, a ceiling, and a surface of the particular level of the structure. The safety system may include a communication system of the fill panel to enable communication with security services and/or emergency services directly from the fill panel.

18 Claims, 11 Drawing Sheets

(56) References Cited

U.S. PATENT DOCUMENTS 6,832,952 B2 * 12/2004 Faltesek et al. ..... 454/338
6,873,256 B2 * 3/2005 Lemelson et al. ..... 340/539.1
7,770,610 B2 * 8/2010 Lisle ..... 141/54
8,316,849 B2 * 11/2012 Lomask et al. ..... 128/204.23
8,371,295 B2 * 2/2013 Turiello ..... 128/202.13
2003/0069002 A1 * 4/2003 Hunter et al. ..... 455/404
2005/0217872 A1 * 10/2005 Oh et al. ..... 169/67
2007/0299473 A1 * 12/2007 Matos ..... 607/5

* cited by examiner

BREATHABLE AIR SAFETY SYSTEM FOR CIVILIANS IN A BUILDING STRUCTURE IN AN EMERGENCY

FIELD OF TECHNOLOGY

This disclosure relates generally to the technical fields of safety systems and, in one example embodiment, to a method and/or system of a breathable air safety system for civilians in a building structure in an emergency.

BACKGROUND

A civilian may be unable to escape out of a structure (e.g., a skyscraper, a building, etc.) when an emergency situation (e.g., a fire accident, an earthquake, etc.) occurs. The civilian may not be able to evacuate because he or she may be injured in an enclosed region (e.g., a room, an elevator, a stairwell, etc.) of the structure. In some instances, the civilian may be trapped on a floor above one in which there is a fire and/or chemical attack. The civilian may not be able to breathe because breathable air inside the structure may be unusable (e.g., depleted, contaminated, etc.). In addition, sometimes a task of locating the civilian trapped in the structure can be difficult because of hazards of the structure (e.g., structural problems, broken stairwells, high temperatures, etc). The civilian may not be able to communicate his or her position in the structure (e.g., may not be able to accurately describe where he or she is over a phone, may not have access to the phone, may not have a light/flare, etc.). It may take time for security services (e.g., of the structure) and/or emergency services (e.g., a firefighter, a police officer, a security guard, etc.) to reach the civilian. As a result, the civilian may suffocate in the structure because it may take too long for the for the security services (e.g., of the structure) and/or the emergency services to reach the civilian.

SUMMARY

Breathable air safety system for civilian personnel is disclosed. In one aspect, the safety system includes a supply unit of a structure to facilitate delivery of breathable air from a source of compressed air to an air distribution system of the structure, a fill panel of the structure to provide a pressure of the breathable air (e.g., may be approximately 10 to 40 Pounds per Square Inch (PSI)) such that the pressure is suitable for direct human consumption through a breathable air apparatus (e.g., may be one of a respiratory mask, a face covering, and/or a protective breathing unit) coupled with the fill panel, and a routing mechanism of the structure to provide a routing between the fill panel and other fill panels of a particular floor through at least one of a wall, a ceiling, and a surface of the particular level of the structure.

The safety system may include a communication system of the fill panel to enable communication with security services (e.g., of the structure) and/or emergency services directly from the fill panel. In addition, the civilian air supply enclosure may be created using a fire rated material and may include a glass cover to provide access to users during an emergency. A breakable cover may also provide access the civilian air supply enclosure when the breakable cover is compromised.

An alarm may be triggered when the breakable cover and/or an enclosure door is compromised that may alert security services (e.g., of the structure) and/or emergency services to a location in the structure where rescue aid may be required. In addition the safety system may include a valve to prevent leakage of the breathable air from the air distribution system potentially leading to loss of system pressure. The safety system may also include a regulation module of the fill panel to maintain the pressure of the breathable air when other breathable air apparatuses are actively being used to deliver the breathable air through the fill panel.

The safety system may include any of a fire rated material and/or a fire rated assembly to enclose a piping of the air distribution system (e.g., the air distribution system may have an ability to withstand elevated temperatures for a prescribed period of time). The safety system may include a robust solid casing to encase the piping (e.g., may use any of a stainless steel, a metal, an aluminum and/or a thermoplastic material that may be compatible for use with compressed air) to prevent physical damage to the air distribution system potentially compromising safety and/or integrity of the air distribution system.

In another aspect, a method of a safety system in a structure may include transferring a breathable air from an air distribution system to a fill panel having a valve to regulate distribution of air to a civilian at a pressure suitable for direct human consumption through a breathable air apparatus coupled with the fill panel, detecting that a quality of the breathable air is safe to use, determining that a breakable cover of the fill panel is compromised, and transmitting a signal that provides a notification of a location of the fill panel to security services (e.g., of the structure) and/or emergency services.

A pressure of the breathable air may be approximately 10 to 40 Pounds per Square Inch (PSI). The breathable air apparatus may be one of a respiratory mask, a face covering (e.g., an elastic face covering), and/or a protective breathing unit.

The method may include providing a communication mechanism between the fill panel and the security services (e.g., of the structure) and/or emergency services through a telephone affixed to the fill panel. The method may maintain a pressure of the breathable air when breathable air apparatuses are actively being used to deliver the breathable air through the fill panel.

In yet another aspect, a fill panel includes a set of breathable air apparatuses coupled to the fill panel to deliver a breathable air from a distribution system to civilians of a building structure during an emergency through the set of breathable air apparatuses, and a regulation module to maintain a pressure of the breathable air when the set of breathable air apparatuses are actively being used to deliver the breathable air to the civilians.

A breathable air apparatus may be made of a mask with a cord and/or a fitting that may be connectable to the fill panel to facilitate delivering of the breathable air from the distribution system to the civilians.

The pressure of the breathable air may be approximately 10 to 40 Pounds per Square Inch (PSI) for each of the set of breathable air apparatuses such that the pressure may be suitable for direct human consumption through the set of a breathable air apparatuses. The breathable air apparatus may be one of a respiratory mask, a face covering, a protective breathing unit etc.

The fill panel may also include a communication mechanism to enable the civilians to communicate with security services (e.g., of the structure) and/or emergency services through a telephone affixed to the fill panel. In addition the fill panel may include a breakable cover affixed to the fill panel that may transmit a signal providing a notification of a location of the fill panel to security services (e.g., of the structure) and/or emergency services when the breakable cover is compromised.

The methods, systems, and apparatuses disclosed herein may be implemented in any means for achieving various aspects, and may be executed in a form of a machine-readable medium embodying a set of instructions that, when executed by a machine, cause the machine to perform any of the operations disclosed herein. Other features will be apparent from the accompanied drawings and from the detailed description that follows.

BRIEF DESCRIPTION OF THE DRAWINGS

Example embodiments are illustrated by ways of examples and not by limitation in the figures of the accompanied drawings, which represent references indicate similar elements and in which.

Other features of the present embodiments will be apparent from the accompanied drawings and from the detailed description that follows.

DETAILED DESCRIPTION

A breathable air safety system for a civilian is disclosed. Although the present embodiments have been described with reference to specific example embodiments, it will be evident that various modifications and changes may be made to these embodiments without departing from the broader spirit and scope of the various embodiments.

Figure 1:
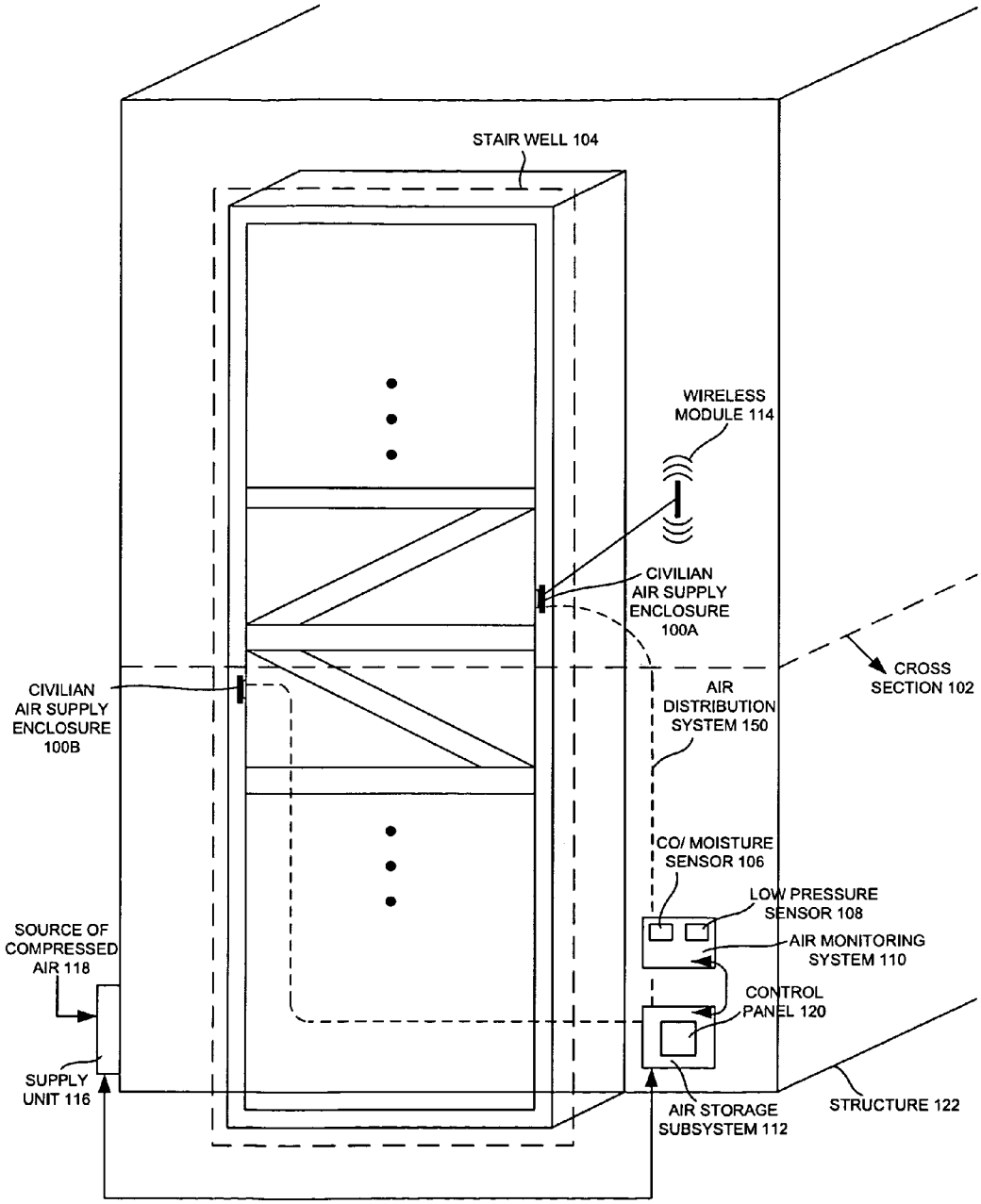
FIG. 1 is a systematic view of a safety system with air monitoring system, according to one embodiment.
Figure 2:
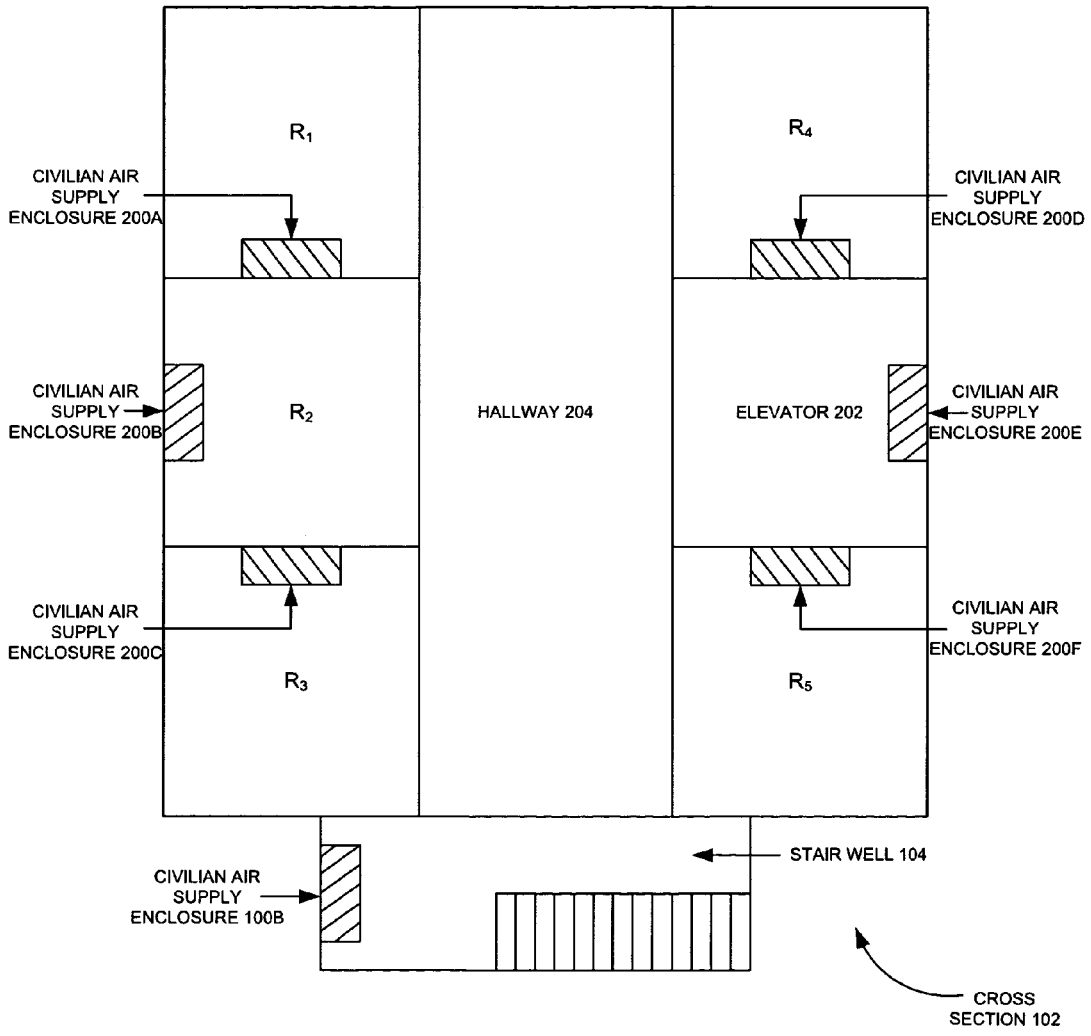
FIG. 2 is a cross sectional view of the safety system of FIG. 1, according to one embodiment.

In one embodiment, a safety system includes a supply unit (e.g., the supply unit 116 of FIG. 1) of a structure (e.g., the structure 122 of FIG. 1) to facilitate delivery of breathable air from a source of compressed air (e.g., the source of compressed air 118 of FIG. 1) to an air distribution system (e.g., the air distribution system 150 of FIG. 1) of the structure 122, a fill panel (e.g., the civilian air supply enclosure 100A of FIG. 1) of the structure 122 to provide a pressure of the breathable air (e.g., approximately 10 to 40 Pounds per Square Inch (PSI)) such that the pressure is suitable for direct human consumption through a breathable air apparatus (e.g., the breathable air apparatuses 306A-N of FIG. 3) coupled with the fill panel (e.g., the civilian air supply enclosure 100A-B of FIG. 1), and a routing mechanism of the structure 122 to provide a routing between the fill panel and other fill panels (e.g., the civilian air supply enclosure 200A-F in FIG. 2) of a particular floor through at least one of a wall, a ceiling, and a surface of the structure 122 (e.g., as illustrated in FIG. 2).

Figure 9:
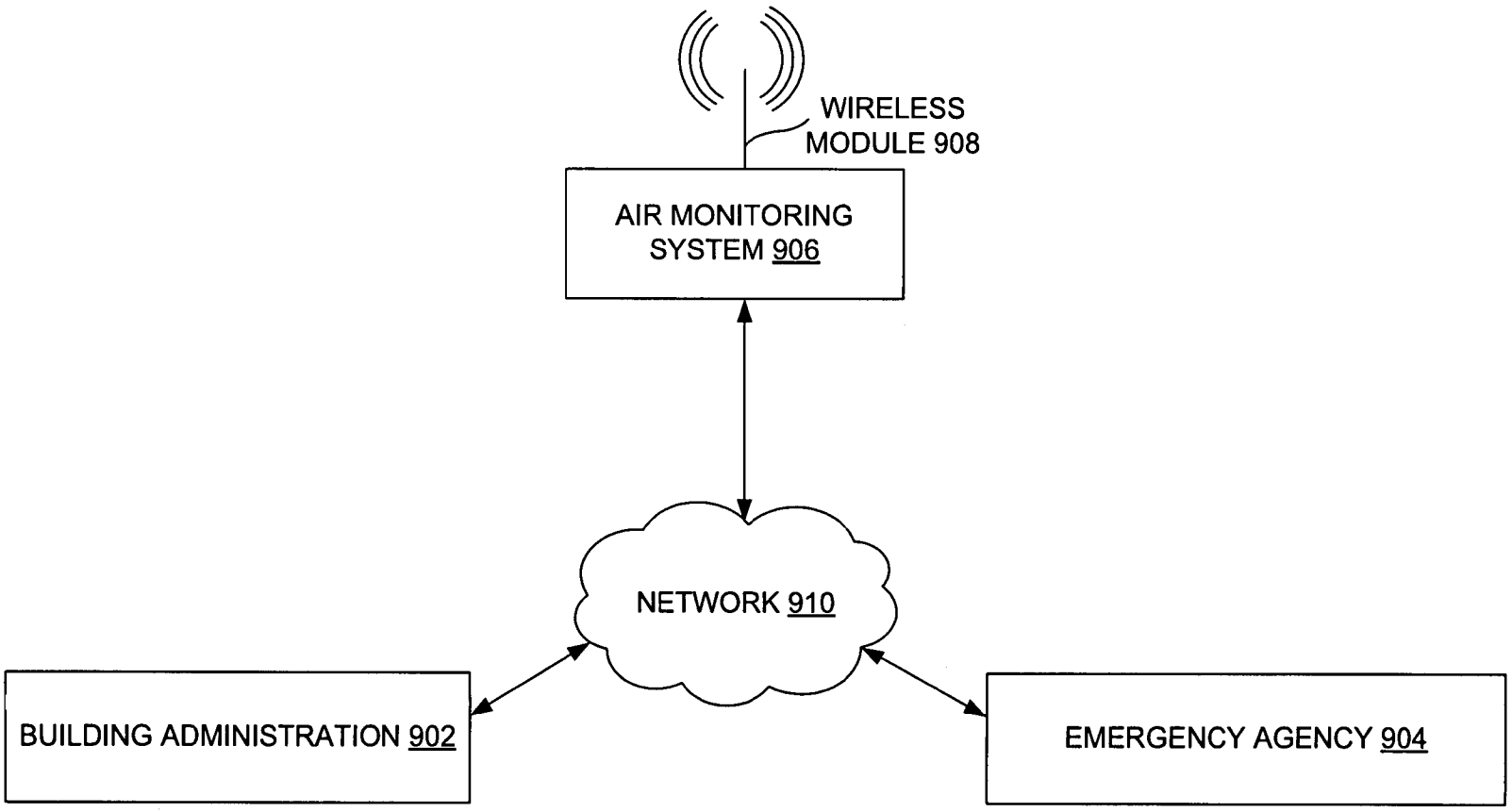
FIG. 9 is a systematic view showing a communication between a building administration, an emergency agency and an air monitoring system through a network, according to one embodiment.

In another embodiment, a method of a safety system in a structure (e.g., the structure 122 of FIG. 1) includes transferring a breathable air from an air distribution system (e.g., the air distribution system 150 of FIG. 1) to a fill panel (e.g., the civilian air supply enclosure 100A of FIG. 1) having a valve to regulate distribution of air to a civilian at a pressure suitable for direct human consumption through a breathable air apparatus (e.g., one of the breathable air apparatuses 306A-N of FIG. 3) coupled with the fill panel (e.g., the civilian air supply enclosure 100A of FIG. 1), detecting that a quality of the breathable air is safe to use, determining that a breakable cover (e.g., the breakable cover 602 of FIG. 6) of the fill panel is compromised, and transmitting a signal that provides a notification of a location of the fill panel to security services (e.g., of the structure) and/or emergency services (e.g., by communicating to the emergency agency 904 of FIG. 9).

In yet another embodiment, a fill panel (e.g., the civilian air supply enclosure 100A of FIG. 1) includes a set of breathable air apparatuses (e.g., the breathable air apparatus 306A-N of FIG. 3) coupled to the fill panel to deliver a breathable air from a distribution system (e.g., the air distribution system 150 of FIG. 1) to civilians (e.g., residents, visitors, office staff, etc.) of a building structure during an emergency (e.g., a fire accident, an earthquake, an explosion, etc.) through the set of breathable air apparatuses 306A-N, and a regulation module (e.g., the regulation module 322 of FIG. 3) to maintain the pressure of the breathable air when the set of breathable air apparatuses 306A-N are actively being used to deliver the breathable air to the civilians.

FIG. 1 is a systematic view of a safety system with an air monitoring system, according to one embodiment. Particularly, FIG. 1 illustrates a civilian air supply enclosure 100A-B, a cross section 102, a stair well 104, a CO/moisture sensor 106, a low pressure sensor 108, an air monitoring system 110, an air storage subsystem 112, a wireless module 114, a supply unit 116, a source of compressed air 118, a control panel 120, a structure 122, and an air distribution system 150, according to one embodiment.

The civilian air supply enclosures 100A-N placed at several locations may facilitate the delivery of breathable air from a source of compressed air 118 to the air distribution system 150. The cross section 102 may be a cross sectional view of a safety system in a building structure. The stair well 104 may be a construction designed to bridge a large vertical distance by dividing it into smaller vertical distances (e.g., stairs, staircase etc.). The CO/moisture sensor 106 may be used to measure the carbon monoxide/moisture content in high pressure breathing air and/or medical air supplies and/or may provide an alarm when safety levels are exceeded.

The low pressure sensor 108 may be used to monitor pressure levels of the breathable air in the air distribution system 150 such that the pressure level may not drop below a threshold pressure level. The air monitoring system 110 may contain multiple sensors such as the CO/moisture sensor 106, the low pressure sensor 108, etc. to track quality of the breathable air in the air distribution system 150. The air storage subsystem 112 may provide an additional supply of air to the structure 122 in addition to the source of compressed air 118. The wireless module 114 may communicate with remote entities (e.g., a supply unit 116, a building administration 902 of FIG. 9, and/or an emergency agency 904 of FIG. 9, etc.).

The supply unit 116 may facilitate delivery of breathable air from the source of compressed air 118 to the air distribution system of the structure 122. The source of compressed air 118 may be a place where the breathable air may be stored in a compressed form for emergency usages. The control panel 120 may have a collection of switches that may be required to monitor and/or control the safety system. The structure 122 may be a building structure such as a shopping mall, a home depot, a mine, a subway, a tunnel, a skyscraper, etc. where people may reside, do business, etc. The air distribution system 150 may be a system to distribute breathable air through out the structure during emergency situations.

In example embodiment, FIG. 1 may illustrate a safety system in the structure 122 which may include the source of compressed air 118, the supply unit 116 that may distribute the breathable air from the air storage subsystem 112. The control panel 120 may control the air distribution system 150 by monitoring the measured data from the sensor devices (e.g., the CO/moisture sensor 106, the low pressure sensor 108 etc.). The control panel may communicate the information to remote devices through the wireless module 114.

The civilian air supply enclosures 100A-N may be placed at a number of locations of the building structure (e.g., a horizontal building structure such as a shopping mall, home depot, a vertical building structure such as a high rise building, a mid rise building, and/or a low rise building, a mine, a subway, and/or a tunnel, etc.) to provide multiple access points to the breathable air in the building structure. The source of compressed air 118 may be kept under a certain pressure (e.g., may be greater than that of the atmosphere).

In one embodiment, the supply unit 116 of the structure 122 may facilitate the delivery of breathable air from the source of compressed air 118 to the air distribution system 150 of the structure 122. The fill panel (e.g., one of the civilian air supply enclosures 100A-N) of the structure 122 may provide a pressure of the breathable air such that the pressure may be suitable for direct human consumption through a breathable air apparatus (e.g., the breathable air apparatus 306A-N of FIG. 3) with the civilian air supply enclosure.

A routing mechanism of the structure 122 may provide a routing (e.g., a centralized routing) between the fill panel and other fill panels of a particular floor through walls of a floor of the structure 122. The pressure of the breathable air may be approximately 10 to 40 Pounds per Square Inch (PSI). A valve may prevent leakage of the breathable air from the air distribution system 150 potentially leading to the loss of system pressure.

The breathable air from the air distribution system 150 may be transferred to the fill panel having a valve that may regulate distribution of air to a civilian at a pressure suitable for direct human consumption through the breathable air apparatuses 306A-N coupled with the fill panel. A quality of the breathable air may be detected such that it may be safe to use. A signal may be transmitted that may provide a notification of a location of the fill panel to security services (e.g., of the structure) and/or emergency services. The pressure of the breathable air may be approximately 10 to 40 Pounds per Square Inch (PSI).

FIG. 2 is a cross sectional view of safety system of FIG. 1, according to one embodiment. Particularly, FIG. 2 illustrates the civilian air supply enclosure 100B, a stair well 104, a civilian air supply enclosure 200A-F, an elevator 202, and a hallway 204, according to one embodiment.

The civilian air supply enclosure 200A-F which may be placed at several locations may facilitate the delivery of breathable air from a source of compressed air 118 to the air distribution system 150. The elevator 202 may be a transport device that may be used to move goods, people, etc. vertically (e.g., may be upwards/downwards) in a building structure. The hallway 204 may be a space in the structure 122 that may lead a way to a main hall.

In example embodiment, FIG. 2 illustrates the structure 122 that may include the elevator 202, the hallway 204, the civilian air supply enclosures 200A-N, the stairwell 104, and rooms (e.g., the rooms R1-R5 as illustrated in FIG. 2). The civilian air supply enclosures 100B, 200A-F placed at several locations in the structure 122 may facilitate the delivery of breathable air from the source of compressed air 118 to the air distribution system 150 during emergency.

Figure 3:
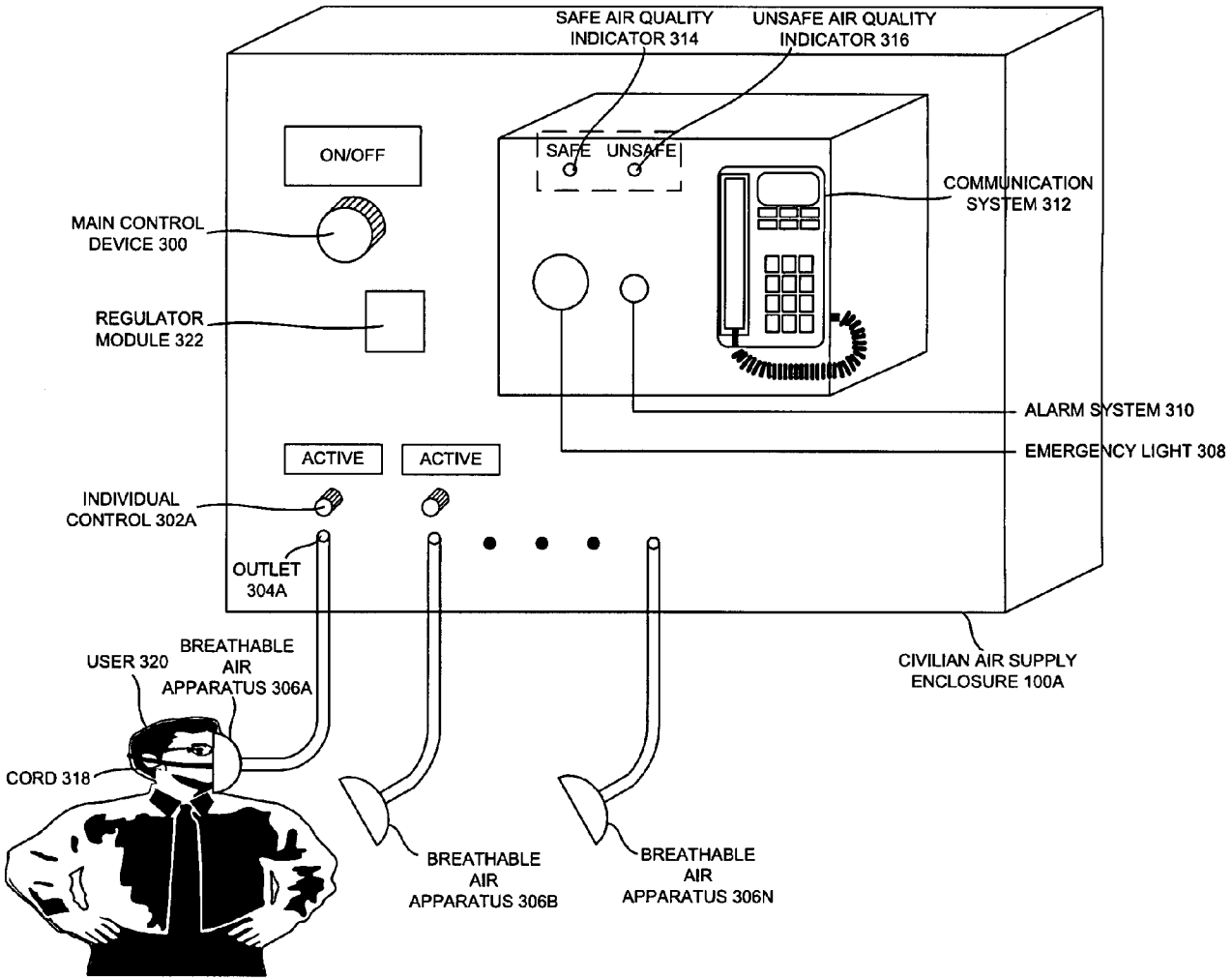
FIG. 3 is a front view of a civilian air supply enclosure of FIG. 1, according to one embodiment.

FIG. 3 is a front view of civilian air supply enclosure of FIG. 1, according to one embodiment. Particularly, FIG. 3 illustrates the civilian air supply enclosure 100A, a main control device 300, individual controls 302A-N, outlets 304A-N, a set of breathable air apparatuses 306A-N, an emergency light 308, an alarm system 310, a communication system 312, an air safe quality indicator 314, an unsafe air quality indicator 316, a cord 318, a user 320, and a regulation module 322, according to one embodiment.

The main control device 300 may be a control device that may enable or disable a civilian air supply enclosure. The individual controls 302A-N may be a switch that may enable a user to control the flow of air coming out from the outlets 304A-N of each of the breathable air apparatuses 306A-N of the civilian air supply enclosure 100A. The outlets 304A-N may be the outlets from the civilian air supply enclosure that may provide breathable air to the users through the breathable air apparatuses 306A-N. Each of the breathable air apparatuses 306A-N may be an apparatus (e.g., a respiratory mask, a face covering, a protective breathing unit etc.) that may enable the user 350 to consume the breathable air.

The emergency light 308 may glow to indicate emergency situations. The alarm system 310 may provide an alert to the security services (e.g., of the structure) and/or emergency services, civilians, etc. The communication system 312 may enable anybody to communicate with the security services (e.g., of the structure) and/or emergency services during emergency when the emergency light 308 turns on. The air safe quality indicator 314 may indicate that the quality of the breathable air in the air distribution system 150 is safe for human consumption. The unsafe air quality indicator 316 may indicate that the quality of the air in the air distribution system is unsafe for human consumption. The cord 318 may enable the user to adjust the breathable air apparatus for consuming the breathable air. The user 320 may be a civilian, a firefighter, etc. The regulation module 322 may regulate the air, and/or manage the systems etc.

In an example embodiment, the civilian air supply enclosure 100A may include the set of breathable air apparatuses 306A-N, which may be coupled to the fill panel and/or may deliver breathable air during an emergency from the set of the breathable air apparatuses 306A-N. The communication system 312, the alarm system 310, the emergency light 308 may indicate and communicate the emergency situation to the security services (e.g., of the structure) and/or emergency services.

In one embodiment, the breathable air apparatus 306A-N (e.g., one of the breathable air apparatuses 306A-N of FIG. 3) may be a respiratory mask, a face covering, and/or a protective breathing unit. The communication system 312 of the fill panel may enable communication with security services (e.g., of the structure) and/or emergency services (e.g., the emergency agency 904 of FIG. 9) directly from the fill panel.

The regulation module 322 of the fill panel may maintain the pressure of the breathable air when other breathable air apparatuses are actively being used to deliver the breathable air through the fill panel. The communication mechanism may be provided between the fill panel and the security services (e.g., of the structure) and/or emergency services through a telephone affixed to the fill panel (e.g., the communication system 312 of FIG. 3).

The set of breathable air apparatuses 306A-N coupled to the fill panel may deliver a breathable air from a distribution system (e.g., the distribution system 404 of FIG. 4) to civilians of a building structure during an emergency through the set of breathable air apparatuses 306A-N. The regulation module 322 may maintain a pressure of the breathable air when the set of breathable air apparatuses 306A-N may actively being used to deliver the breathable air to the civilians.

Each of the set of breathable air apparatuses 306A-N may be a mask with the cord 318 and a fitting that may be connectable to the fill panel may facilitate the delivery of the breathable air from the distribution system 404 to the civilians. The pressure of the breathable air may be approximately 10 to 40 Pounds per Square Inch (PSI) for each of the set of breathable air apparatuses such that the pressure may be suitable for direct human consumption through the set of breathable air apparatuses 306A-N.

Figure 4:
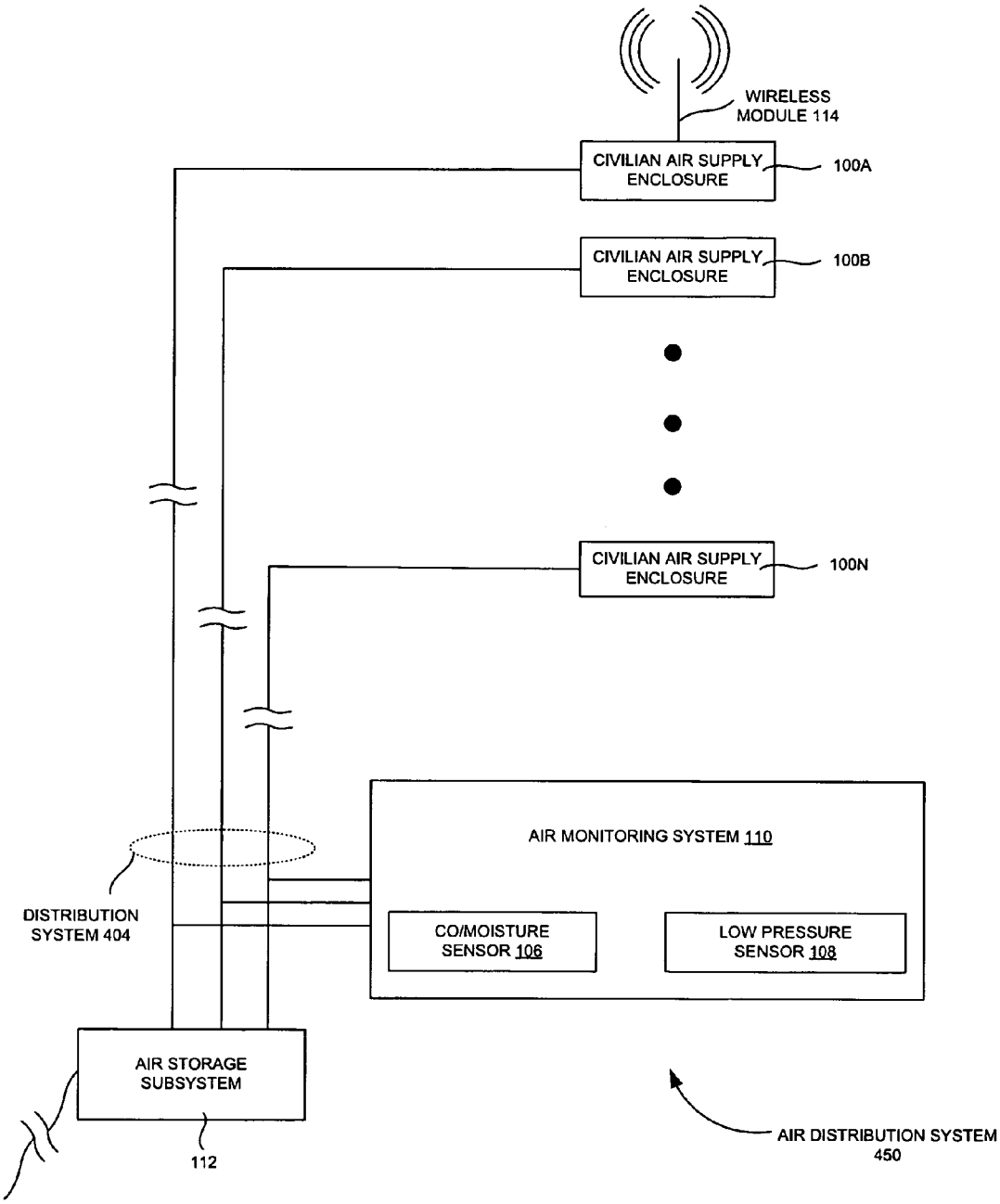
FIG. 4 is a systematic view of an air distribution system, according to one embodiment.

FIG. 4 is a systematic view of an air distribution system, according to one embodiment. Particularly, FIG. 4 illustrates civilian air supply enclosures 100A-N, a CO/moisture sensor 106, a low pressure sensor 108, an air monitoring system 110, an air storage subsystem 112, a wireless module 114, and a distribution system 404, according to one embodiment.

The distribution system 404 may be the method of air distribution from the air storage subsystem 112 to the civilian air supply enclosure 100A-N where the air may be monitored by the air monitoring system 110.

In an example embodiment, FIG. 4 illustrates the air distribution system 450 that may include a number of civilian air supply enclosures (e.g., the civilian air supply enclosures 100A-N) connected to the air storage subsystem 112 through the distribution system 404. The air distribution system 450 may include an air monitoring system 110 having the CO/Moisture sensor 106 and/or the low pressure sensor 108 to detect presence of the CO/moisture in the air storage subsystem 112.

Figure 5:
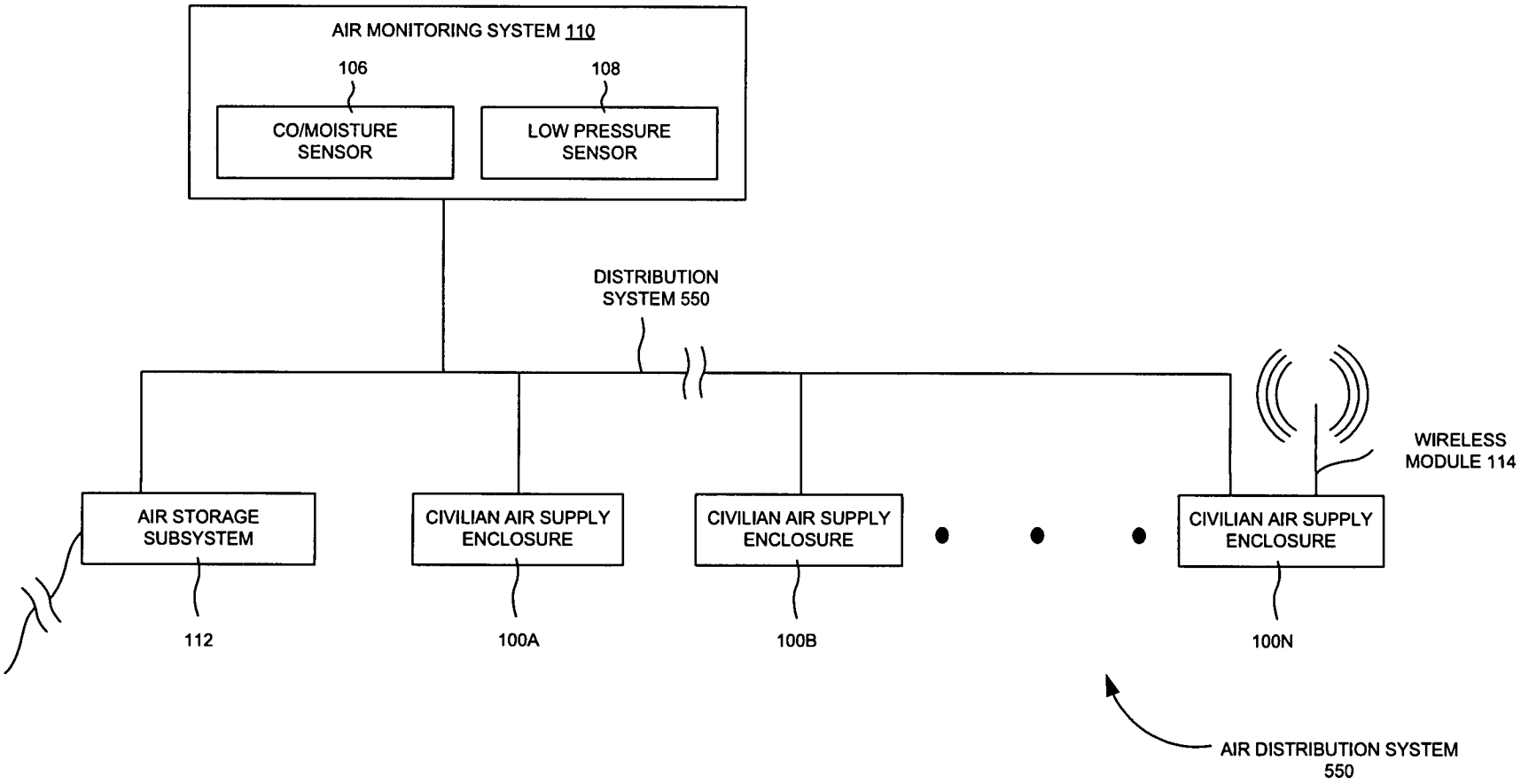
FIG. 5 is a systematic view of the air distribution system having civilian air supply enclosures in a building structure, according to one embodiment.

FIG. 5 is a system view of air distribution system having fill panels in a building structure, according to one embodiment. Particularly, FIG. 5 illustrates a civilian air supply enclosure 100A-N, a CO/moisture sensor 106, a low pressure sensor 108, the air monitoring system 110, an air storage subsystem 112, and an air distribution system 550, according to one embodiment.

In an example embodiment, the air distribution system 450 may include a number of the air storage subsystems 112, and/or the civilian air supply enclosures 100A-N that may be coupled to the rest of the air distribution system 150 through a distribution system 404. The air distribution system 150 may also include the air monitoring system 110 having the CO/Moisture sensor 106 and the low pressure sensor 108. Each air distribution system (e.g., the air distribution system 550) may be used in conjunction with one another depending on the particular architectural style of the building structure in a manner that provides most efficient access to the breathable air of the air distribution system 550 reliably.

Figure 6:
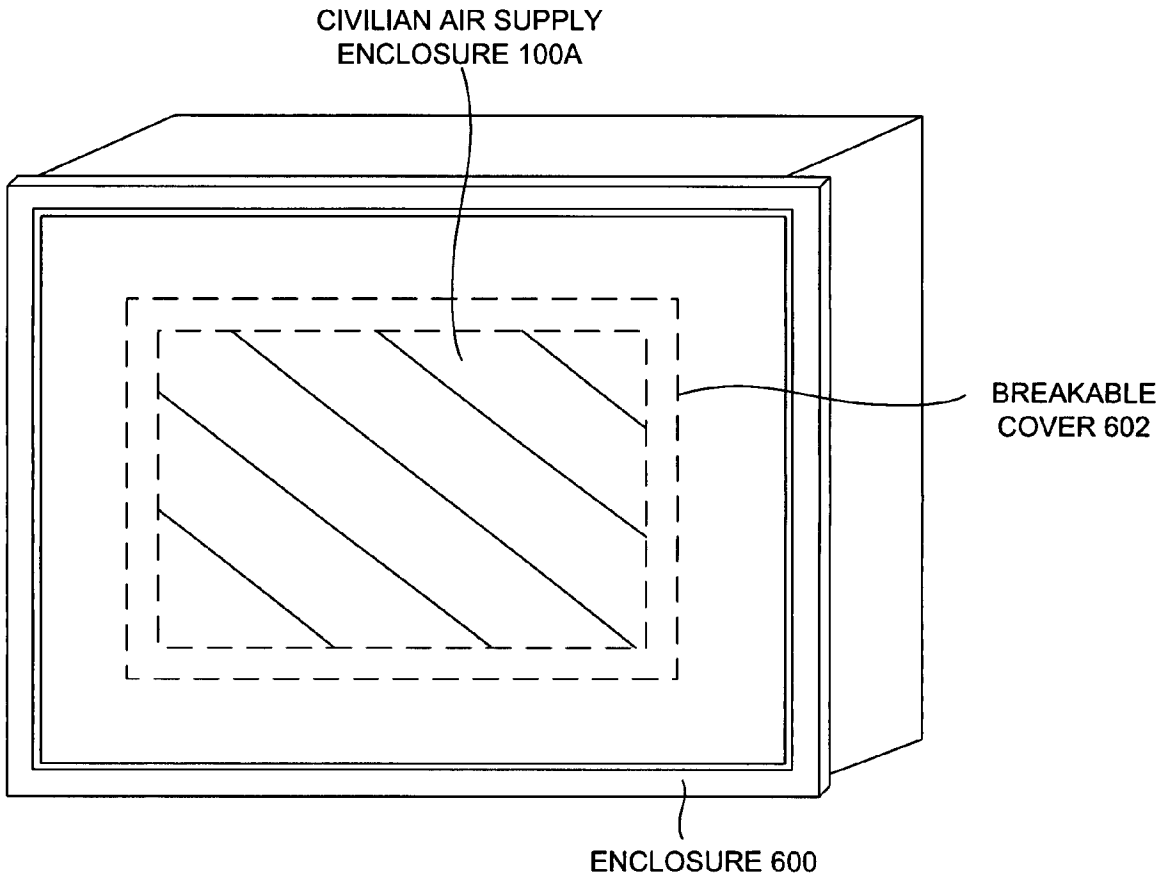
FIG. 6 is a systematic view of an enclosure of an emergency alert system, according to one embodiment.

FIG. 6 is a systematic view of enclosure of an emergency alert system, according to one embodiment. Particularly, FIG. 6 illustrates the civilian air supply enclosure 100A, an enclosure 600, and breakable cover 602, according to one embodiment.

The enclosure 600 may be a covering structure provided to protect the civilian air supply enclosure 100A. The breakable cover 602 may be a cover that may be easily broken at the required emergency time (e.g., glass covering, etc.).

In example embodiment, FIG. 6 illustrates the enclosure that may include the civilian air supply enclosure 100A which may be covered by the breakable cover 602 such that during the emergency time the user 350 may break the cover and may gain access to the civilian air supply enclosure 100A.

In one embodiment, the civilian air supply enclosure may be created using a fire rated material and may include a glass cover to provide access to users during an emergency. The breakable cover 602 may provide access the civilian air supply enclosure 600 when the breakable cover is compromised.

An alarm (e.g., using the alarm system 310 of FIG. 3) may be triggered when the breakable cover 602 and or/an enclosure door (not shown) is compromised that may alert an security services (e.g., of the structure) and/or emergency services (e.g., the emergency agency 904 of FIG. 9) to a location in the structure 122 where a rescue aid is required. It may be determined whether the breakable cover 602 of the fill panel is compromised. The breakable cover 602 affixed to the fill panel may transmit a signal providing a notification of a location of the fill panel to security services (e.g., of the structure) and/or emergency services when the breakable cover 602 is compromised.

Figure 7:
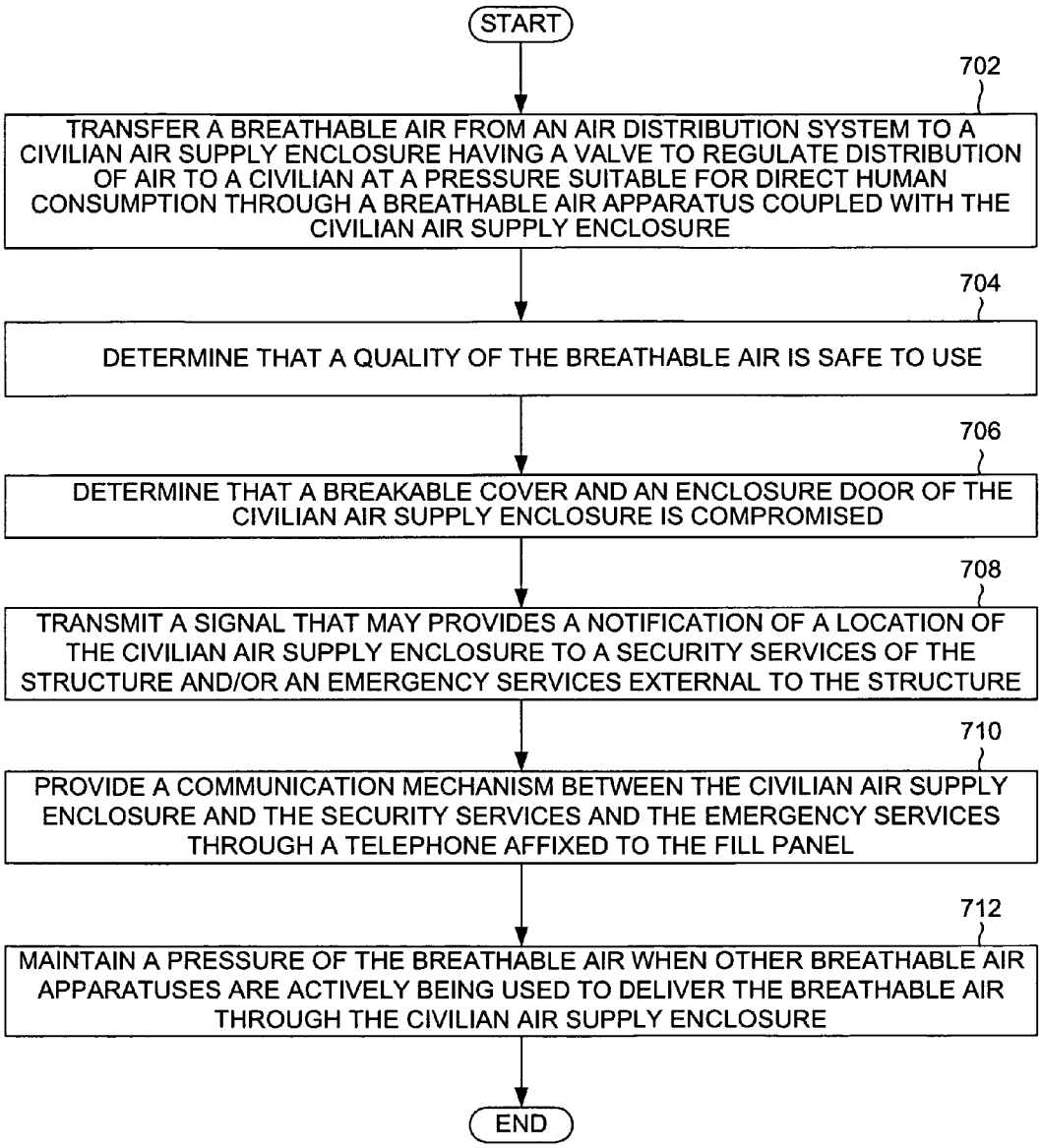
FIG. 7 is a process flow that shows how a breathable air may be transferred from an air distribution system to a fill panel, according to one embodiment.

FIG. 7 is a process flow of transferring a breathable air from an air distribution system to a fill panel, according to one embodiment. In operation 702, a breathable air may be transferred from an air distribution system (e.g., the air distribution system 150 of FIG. 1) to a civilian air supply enclosure (e.g., one of the civilian air supply enclosures 100A-N of FIG. 1) having a valve to regulate the distribution of air (e.g., using the regulation module 322 of FIG. 3) to a civilian at a pressure suitable for direct human consumption through a breathable air apparatus (e.g., the breathable air apparatus 300A of FIG. 3) coupled with the fill panel. In operation 704, it may be determined (e.g., by using the CO/moisture sensor 106 of FIG. 1) that a quality of the breathable air is safe to use.

In operation 706, it may be determined that a breakable cover (e.g., the breakable cover 602 of FIG. 6) of the civilian air supply enclosure may be compromised. In operation 708 a signal may be transmitted (e.g., by using the communication system 312 of FIG. 3) that may provide a notification of a location of the fill panel to security services (e.g., of the structure) and/or emergency services. The pressure of the breathable air may be approximately 10 to 40 Pounds per Square Inch (PSI). The breathable air apparatus may be one of a respiratory mask, a face covering, and/or a protective breathing unit.

In operation 710, a communication mechanism between the fill panel and the security services (e.g., of the structure) and/or emergency services may be provided (e.g., by using the communication system 312 of FIG. 3) through a telephone affixed to the fill panel (e.g., as illustrated in FIG. 3). In operation 712, a pressure of the breathable air may be maintained (e.g., using the low pressure sensor 108 of FIG. 1) when other breathable air apparatuses may actively being used to deliver the breathable air through the fill panel.

Figure 8B:
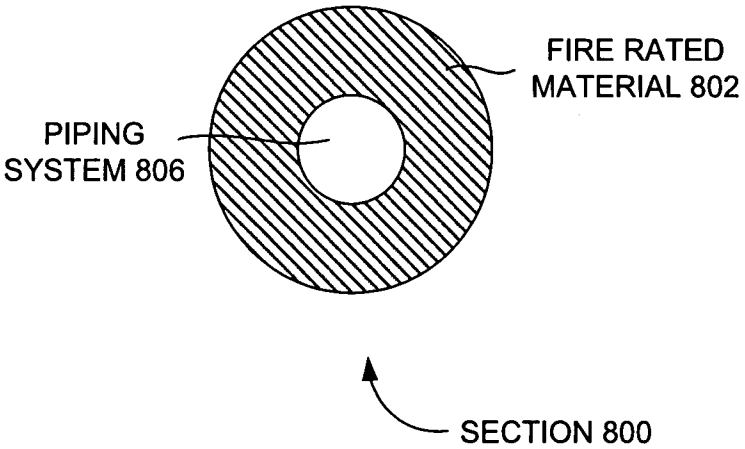
FIG. 8A and FIG. 8B is a diagrammatic view and a cross sectional view of a piping system respectively in a fire rated material, according to one embodiment.
Figure 8A:
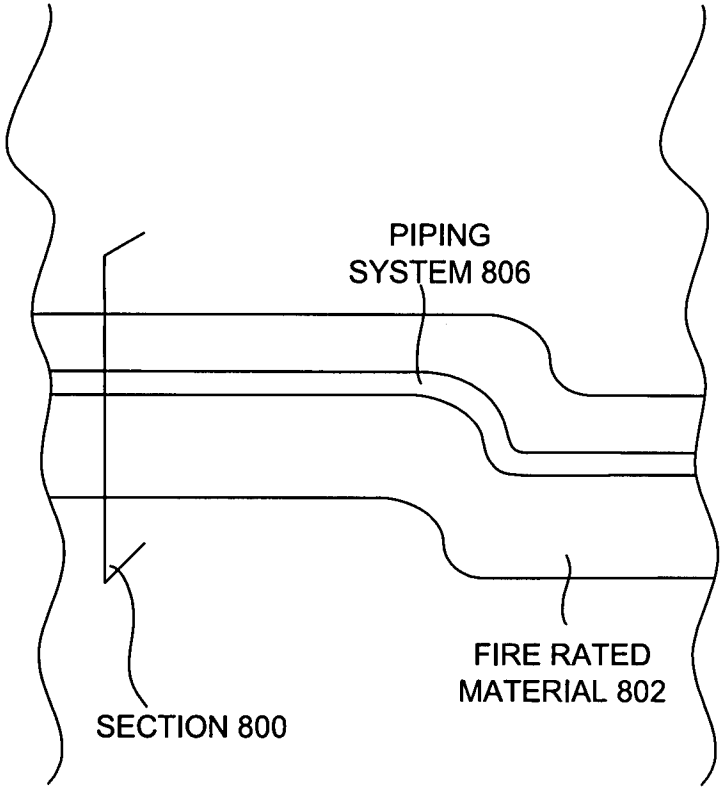

FIG. 8A and FIG. 8B is a diagrammatic view and a cross sectional view of a piping system of the safety system respectively in a fire rated material, according to one embodiment. Particularly, FIG. 8A illustrates a section 800, a fire rated material 802, and a piping 806, according to one embodiment.

The section 800 may illustrate the section of piping 806. The fire rated material 802 may enclose the piping 806. The fire rated material may be certified to withstand elevated temperature for a period of time. The piping 806 may be made out of any of a stainless steel, a metal, an aluminum, a thermoplastic material etc. that may be compatible for use with compressed air.

In example embodiment, FIG. 8A and FIG. 8B may illustrate a piping system where the piping 806 may be covered and/or protected by the fire rated material 802.

In one embodiment, any of a fire rated material (e.g., the fire rated material 802 of FIG. 8) and/or a fire rated assembly may enclose a piping (e.g., the piping 806 of FIG. 8) of the air distribution system 150 such that the air distribution system 150 may have an ability to withstand elevated temperatures for a prescribed period of time. A robust solid casing may encase the piping 806 to prevent physical damage to the air distribution system 150 potentially compromising a safety and integrity of the air distribution system 150. The piping 806 may comprise any of a stainless, a thermoplastic material etc. that may be compatible for use with compressed air.

FIG. 9 is a systematic view showing a communication between a building administration, an emergency agency 904 and an air monitoring system 906 through a network, according to one embodiment. Particularly, FIG. 9 illustrates a building administration 902, an emergency agency 904, an air monitoring system 906, a wireless module 908, and a network 910, according to one embodiment The building administration 902 may be an administrative department of the building that may be informed when an emergency occurs. The emergency agency 904 may be an expert in handling emergency situations by providing various kinds of services (e.g., life rescue, medical help, etc.). The air monitoring system 906 may monitor the system to ensure the safe condition of the breathable air in the building.

The wireless module 908 may be a communication system that may inform the building administration 902, the emergency agency, etc. when an emergency situation occurs. The network 910 may be one of a LAN, a WAN, or an internet network that may enable communication between the building administration 902, the emergency agency 904, the air monitoring system 906, etc.

Figure 10:
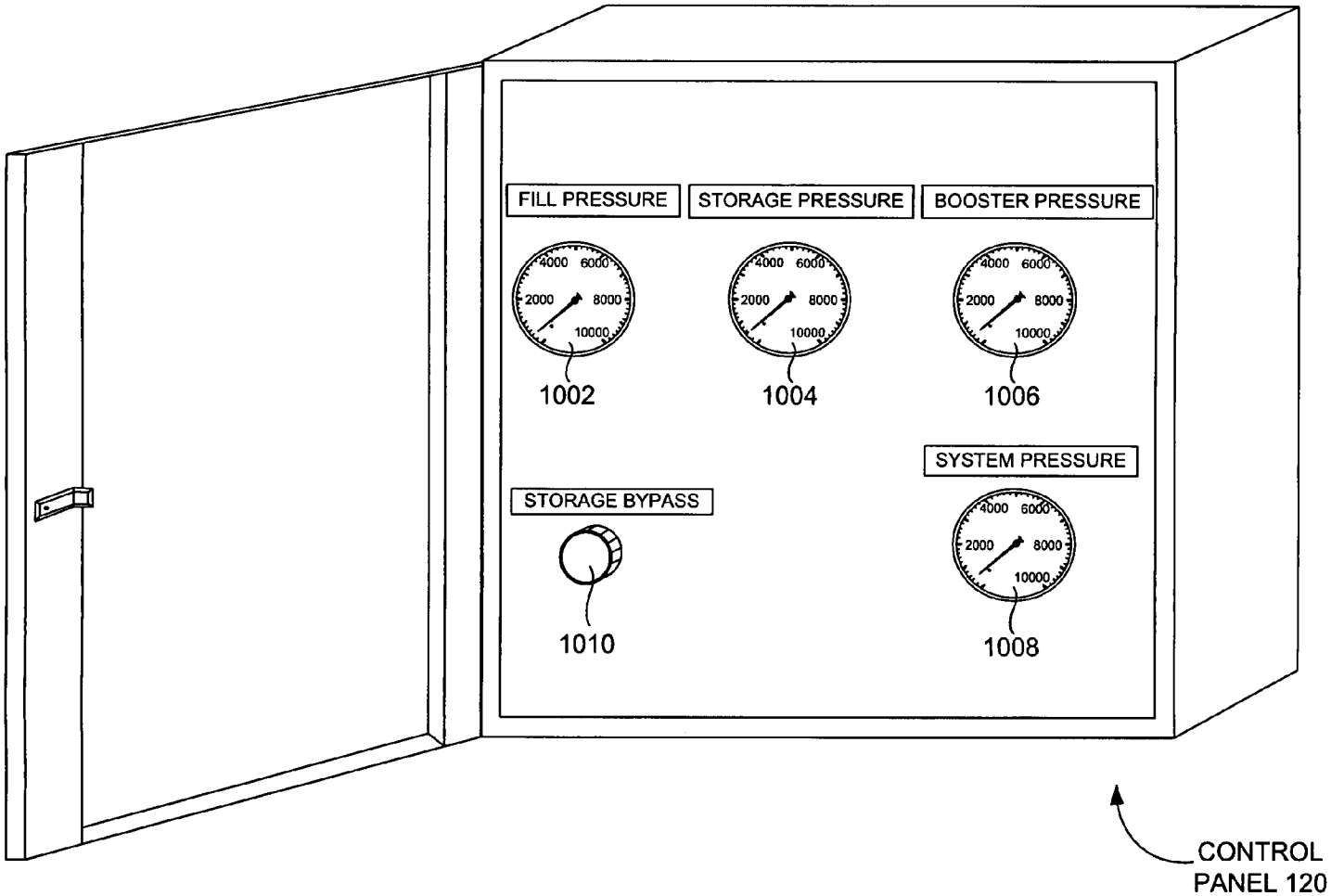
FIG. 10 is a systematic view of a control panel of an air storage sub-system, according to one embodiment.

In example embodiment, FIG. 9 may illustrate the communication between the building administration 902, the emergency agency 904, and/or the air monitoring system 906 through the network 910. The wireless module 908 may communicate with the building administration 902 and/or the emergency agency 904 when an emergency situation (e.g., degradation of breathable air, pressure change in the breathable air, etc.) occurs, FIG. 10 is a systematic view of a control panel of an air storage sub-system, according to one embodiment. Particularly, FIG. 10 illustrates a civilian fill pressure indicator 1002, a storage pressure indicator 1004, a booster pressure indicator 1006, a system pressure indicator 1008, a storage bypass 1010, and a control panel 120, according to one embodiment.

The civilian fill pressure indicator 1002 may indicate the pressure level at which the breathable air is being delivered by the source of compressed air to the air distribution system. The storage pressure indicator 1004 may display the pressure level of air storage tanks in the air storage subsystem 112. The booster pressure indicator 1006 may display the pressure level of the booster tank 1106. The system pressure indicator 1008 may indicate the current pressure level of the breathable air in the air distribution system. The storage bypass 1010 may directly supply the air to the air distribution system.

In an example embodiment, the control panel 120 may include a civilian fill pressure indicator 1002, a storage pressure indicator 1004, a booster pressure indicator 1006, a system pressure indicator 1008 and/or a storage bypass 1010.

Figure 11:
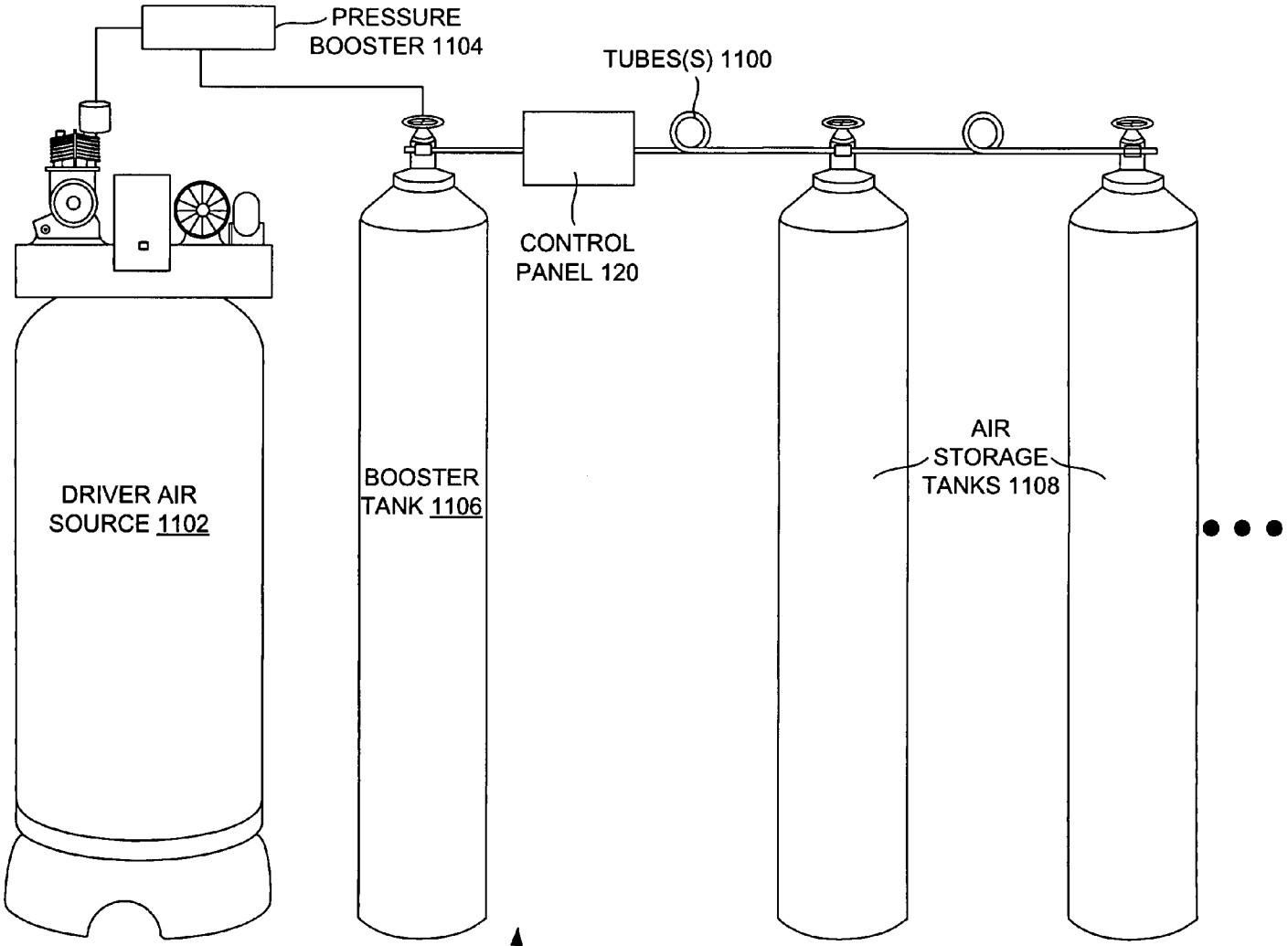
FIG. 11 is a systematic view of an air storage subsystem, according to one embodiment.

FIG. 11 is a systematic view of an air storage subsystem, according to one embodiment. Particularly, FIG. 11 illustrates tube(s) 1100, a driver air source 1102, a pressure booster 1104, a booster tank 1106, air storage tanks 1108, and a control panel 120, according to one embodiment.

The control panel 120 may provide status information regarding the various components of the air storage subsystem 112. The tubes 1100 may couple each of the air storage tanks 1108 to one another in a looped configuration to increase robustness of the tubes 1000. The driver air source 1102 may be used to pneumatically drive the pressure booster 1104. The pressure booster 1104 may maintain a pressure of the air distribution system such that the pressure is suitable for a direct human consumption.

The booster tank 1106 may store air at a higher pressure than the air stored in the air storage tanks 1108 to ensure that the air distribution system have enough supply of the breathable air in case of an emergency. The air storage tanks 1108 may store the air that may be consumed through the breathable air apparatuses.

In an example embodiment, the air storage subsystem 112 may include a control panel 120, tubes 1100, a driver air source 1102, a pressure booster 1104, a booster tank 1106, and/or any number of the air storage tanks 1108. The air storage tanks 1108 and/or a booster tank 1106 of the air storage subsystem 112 may be supplied with breathable air through a source of compressed air that may be coupled to the air distribution system through the supply unit 116. The air storage subsystem 112 may provide a spare source of breathable air to the air distribution system in addition to the source of compressed air.

Although the present embodiments have been described with reference to specific example embodiments, it will be evident that various modifications and changes may be made to these embodiments without departing from the broader spirit and scope of the various embodiments. For example, the various devices (e.g., modules, analyzers, generators, etc.) described herein may be enabled and operated using hardware circuitry (e.g., CMOS based logic circuitry, etc.), firmware, software and/or any combination of hardware, firmware, and/or software (e.g., embodied in a machine readable medium, etc). For example, the wireless module 114, the regulation module 322, the wireless module 908, and other modules of FIGS. 1-11 may be enabled using a wireless circuit, a regulation circuit, and other circuits using one or more of the technologies described herein.

In addition, it is evident that the various operations, processes, and methods disclosed herein may be embodied in a machine-readable medium and/or a machine accessible medium compatible with a data processing system (e.g., a computer system, etc.), and may be performed in any order (e.g., including using means for achieving the various operations, etc). Accordingly, the specification and drawings are to be regarded in an illustrative rather than a restrictive sense.

What is claimed is:

1. A safety system, comprising:

a supply unit, configured to be part of a building structure to facilitate delivery of breathable air from a source of compressed air to an air distribution system of the building structure, the air distribution system comprising a low pressure sensor, a moisture sensor and a CO sensor to track quality of the breathable air therein, and measured data from the low pressure sensor, the moisture sensor and the CO sensor being configured to be communicated to a remote device through a wireless module communicatively coupled to the air distribution system;

a plurality of civilian air supply enclosures, located in a corresponding plurality of rooms on either side of a hallway of the building structure along a length of the building structure and along a stairwell of the building structure, each civilian air supply enclosure being configured to: receive breathable air from the air distribution system and regulate distribution of the breathable air to provide a pressure of the breathable air that is suitable for direct human consumption through a breathable air apparatus coupled with the each civilian air supply enclosure, the pressure of the breathable air being approximately 10 to 40 Pounds per Square Inch (PSI); and a routing mechanism of the building structure to provide routing of the breathable air from the air distribution system between the civilian air supply enclosures through at least one of a wall, a ceiling and a surface of particular levels of the building structure, wherein the air distribution system further comprises an air storage subsystem to provide an additional supply of air to the building structure in addition to the source of compressed air, the air storage subsystem comprising:

a plurality of air storage tanks, each of which is coupled to another through a tube in a looped configuration to increase robustness thereof, an air storage tank thereof comprising air to be consumed through the breathable air apparatuses;

a booster tank configured to store air at a higher pressure than air stored in the plurality of air storage tanks, the booster tank being coupled to the plurality of air storage tanks through another tube also in a looped configuration;

a pressure booster coupled to the booster tank to maintain a pressure of the air distribution system such that the pressure is suitable for the direct human consumption through the breathable air apparatus;

a driver air source to pneumatically drive the pressure booster; and a control panel to provide status information regarding components of the air storage subsystem.

2. The safety system of claim 1, wherein the breathable air apparatus is one of a respiratory mask, a face covering, and a protective breathing unit.

3. The safety system of claim 1, further comprising:

a communication system of each of the civilian air supply enclosures to enable communication with at least one of a security service and an emergency services directly from the each of the civilian air supply enclosures.

4. The safety system of claim 1, wherein the each civilian air supply enclosure is created using a fire rated material and includes a breakable cover to provide access thereto to users during emergency.

5. The safety system of claim 4, wherein the breakable cover is configured to provide access to the each civilian air supply enclosure upon compromise thereof.

6. The safety system of claim 5, wherein an alarm is triggered when at least one of the breakable cover and an enclosure door is compromised that alerts at least one of a security services and an emergency services to a location in the building structure where rescue aid is required.

7. The safety system of claim 1, further comprising a valve to prevent leakage of the breathable air from the air distribution system.

8. The safety system of claim 1, wherein the each civilian air supply enclosure comprises a regulation module to maintain the pressure of the breathable air when other breathable air apparatuses are actively being used to deliver the breathable air through the each civilian air supply enclosure.

9. The safety system of claim 1, further comprising any of a fire rated material and a fire rated assembly to enclose a piping of the air distribution system such that the air distribution system has an ability to withstand elevated temperatures for a prescribed period of time.

10. The safety system of claim 9, further comprising a robust solid casing to encase the piping to prevent physical damage to the air distribution system.

11. The safety system of claim 10, wherein the piping comprises any of a stainless steel, a metal, an aluminum and a thermoplastic material that is compatible for use with compressed air.

12. A method of a safety system in a building structure, comprising:

providing a plurality of civilian air supply enclosures in a corresponding plurality of rooms on either side of a hallway of the building structure along a length of the building structure and along a stairwell of the building structure;

transferring breathable air from an air distribution system to a civilian air supply enclosure of the plurality of civilian air supply enclosures, each civilian air supply enclosure having a valve to regulate distribution of air to a civilian at a pressure suitable for direct human consumption through a breathable air apparatus coupled with the civilian air supply enclosure, the pressure of the breathable air being approximately 10 to 40 PSI;

tracking quality of the breathable air in the air distribution system through a low pressure sensor, a moisture sensor and a CO sensor;

communicating measured data from the low pressure sensor, the moisture sensor and the CO sensor to a remote device through a wireless module communicatively coupled to the air distribution system;

distributing the breathable air from the air distribution system through at least one of a wall, a ceiling, and a floor between the civilian air supply enclosures of the building structure;

providing, through an air storage subsystem of the air distribution system, an additional supply of air to the building structure in addition to the source of compressed air;

providing a plurality of air storage tanks as part of the air storage subsystem, an air storage tank thereof comprising air to be consumed through the breathable air apparatus;

coupling each air storage tank of the plurality of air storage tanks to another of the air storage tanks through a tube in a looped configuration to increase robustness thereof;

storing, through a booster tank, air at a higher pressure than air stored in the plurality of air storage tanks;

coupling the booster tank to the plurality of air storage tanks through another tube also in a looped configuration;

maintaining, through a pressure booster coupled to the booster tank, a pressure of the air distribution system such that the pressure is suitable for the direct human consumption through the breathable air apparatus;

pneumatically driving the pressure booster through a driver air source; and providing status information regarding components of the air storage subsystem through a control panel.

13. The method of claim 12, wherein the breathable air apparatus is one of a respiratory mask, a face covering, and a protective breathing unit.

14. The method of claim 12, further comprising at least one of:

providing a communication mechanism between a civilian air supply enclosure and at least one of security services and emergency services of the building structure through a telephone; and maintaining a pressure of the breathable air when other breathable air apparatuses are actively being used to deliver the breathable air through the civilian air supply enclosure.

15. A building structure comprising:

a plurality of civilian air supply enclosures, located in a corresponding plurality of rooms on either side of a hallway of the building structure along a length of the building structure and along a stairwell of the building structure, each civilian air supply enclosure being configured to: receive breathable air from an air distribution system of the building structure and regulate distribution of the breathable air to provide a pressure of the breathable air that is suitable for direct human consumption through a breathable air apparatus coupled with the each civilian air supply enclosure, the pressure of the breathable air being approximately 10 to 40 PSI, the air distribution system comprising a low pressure sensor, a moisture sensor and a CO sensor to track quality of the breathable air therein, and measured data from the low pressure sensor, the moisture sensor and the CO sensor being configured to be communicated to a remote device through a wireless module communicatively coupled to the air distribution system; and a regulation module to maintain an appropriate pressure of the breathable air during an active use of the breathable air apparatus, wherein a routing mechanism is implemented in the building structure to enable distribution of the breathable air from the air distribution system through at least one of a wall, a ceiling, and a floor between the civilian air supply enclosures of the building structure, wherein the air distribution system further comprises an air storage subsystem to provide an additional supply of air to the building structure in addition to the source of compressed air, the air storage subsystem comprising:

a plurality of air storage tanks, each of which is coupled to another through a tube in a looped configuration to increase robustness thereof, an air storage tank thereof comprising air to be consumed through the breathable air apparatus;

a booster tank configured to store air at a higher pressure than air stored in the plurality of air storage tanks, the booster tank being coupled to the plurality of air storage tanks through another tube also in a looped configuration;

a pressure booster coupled to the booster tank to maintain a pressure of the air distribution system such that the pressure is suitable for the direct human consumption through the breathable air apparatus;

a driver air source to pneumatically drive the pressure booster; and a control panel to provide status information regarding components of the air storage subsystem.

16. The building structure of claim 15, wherein the breathable air apparatus is a mask with a cord and a fitting that is connectable to a fill panel to facilitate delivery of the breathable air from the air distribution system.

17. The building structure of claim 15, wherein the breathable air apparatus is one of a respiratory mask, a face covering, and a protective breathing unit.

18. The building structure of claim 15, wherein a civilian air supply enclosure of the plurality of civilian air supply enclosures further comprises:

a telephone to enable communication with at least one of security services and emergency services of the building structure; and a breakable cover affixed thereto that transmits a signal providing a notification of a location thereof to the at least one of the security services and the emergency services when at least one of the breakable cover and an enclosure door is compromised.

* * * * *